US005951182A

United States Patent [19]

Van Weverberg et al.

[11] Patent Number: 5,951,182

[45] Date of Patent: Sep. 14, 1999

[54] PRINTER FOR PRINTING IMAGES ON A SUBSTRATE WEB

[75] Inventors: Erik Gabriel Gerardus Van Weverberg, Mortsel; Erik Marcel Lieva Armand Bollansee, Borgerhout, both of Belgium

[73] Assignee: Xeikon N.V., Mortsel, Belgium

[21] Appl. No.: 09/026,444

[22] Filed: Feb. 19, 1998

[30] Foreign Application Priority Data

Feb. 26, 1997 [EP] European Pat. Off. ..... 97301251

[51] Int. Cl.[6] ..... B41J 17/02

[52] U.S. Cl. ..... 400/708; 399/228; 347/116; 400/611

[58] Field of Search ..... 400/611, 613, 400/706, 708, 579; 101/228; 399/228, 384; 347/115, 116, 112

[56] References Cited

U.S. PATENT DOCUMENTS

| | | | |
|---|---|---|---|
| 3,858,777 | 1/1975 | Rodek | 226/30 |
| 4,541,337 | 9/1985 | Jean-Paul Schaul | 101/227 |
| 5,061,946 | 10/1991 | Helmbold et al. | 400/708 |
| 5,315,323 | 5/1994 | Ohshima et al. | 346/159 |
| 5,322,380 | 6/1994 | Crocker | 400/611 |
| 5,499,093 | 3/1996 | Aerens et al. | 355/326 |
| 5,570,960 | 11/1996 | Smith | 400/74 |
| 5,803,635 | 9/1998 | Austin et al. | 400/708 |

FOREIGN PATENT DOCUMENTS

| | | | |
|---|---|---|---|
| 0624477 | 11/1994 | European Pat. Off. . | |
| 60-196380 | 10/1985 | Japan | 400/708 |

*Primary Examiner*—Christopher A. Bennett
*Attorney, Agent, or Firm*—Baker & Botts, L.L.P.

[57] ABSTRACT

The printer comprises:

a digital printing station (12);

a support (20) for a roll (22) of the substrate web (24) carrying a plurality of synchronisation marks;

means (28) for continuously feeding the substrate web (24) from the roll (22) past the printing station (12);

a sensing device (32) positioned upstream of the printing station (12) for sensing the synchronisation marks on the web (24); and control means (38) for initiating a printing sequence at the printing station (12) in response to the sensing of each of the synchronisation marks (26, 34, 36). Thereby a plurality of images are printed on the web (24), each at a predetermined location in the transport direction relative to an associated one of the synchronisation marks (26, 34, 36).

18 Claims, 2 Drawing Sheets

PRINTER FOR PRINTING IMAGES ON A SUBSTRATE WEB

FIELD OF THE INVENTION

This invention relates to printers.

BACKGROUND OF THE INVENTION

It is known to print images, especially variable images, on pre-printed stock. For example, U.S. Pat. No. 3,858,777 (Rodek/Xerox Corporation) describes an apparatus for printing prerecorded information on a pre-printed web. The image carried on the pre-printed web may be, for example business forms, it being necessary to print the variable data in registration with the layout of the forms. The web carries uniformly spaced marks which are detected by a sensor as the web is unwound from a roll. By detection of the marks, the displacement of the web can be determined. Variable information to be printed on the web, is carried on a film strip. The speed of the film strip through an exposure device can be adjusted to match the determined speed of the web.

The printer described by Rodek operates on the basis of the substrate web moving at a nominally constant speed and of the provision of uniformly spaced marks on the web. In practice, the requirements may be difficult to meet accurately. Variations in operating conditions or in the condition of the web, may result in minor variations in the web speed. Furthermore, after the substrate web has been pre-printed, it is rolled and stored prior to use, during which some dimensional changes in the web, such as stretching and relaxing, may occur. The result of this is that marks pre-printed on the web may no longer be equally spaced. Furthermore, it may well be desirable to pre-print images of different lengths, with the result that the use of uniformly spaced marks on the web is no longer appropriate. The printer described by Rodek also has the disadvantage that, should any change in web speed be made, a correction in the timing of the exposure is made at a point which may be located in the middle of an image. An image carrying such a intermediate correction is undesirable.

U.S. Pat. No. 5,315,323 (Ohshima et al./Ricoh Company Ltd.) describes a color image forming apparatus for forming an image on a paper web by sensing a register mark formed on the paper by a writing head. The distance between the register mark and the sensor and the distance between the writing head and the paper web are kept constant. This arrangement is not suitable for the printing of pre-printed stock.

European patent application EP 624477 (Canon K K) describes a method in which an image including a mark is printed on a substrate by screen printing. Another image is then printed on the substrate by ink-jet printing on the basis of the detection of the pre-printed mark. The mark detector is mounted on the ink jet printing head. The substrate is fed past the ink jet printing head in a step-wise manner, the mark detector being moved laterally into a parking position as printing continues. This arrangement does not allow for the printing of an image to be initiated at a position other than at the location of the mark. Furthermore, the use of step-wise transport of the substrate is to be avoided for high quality high speed print work.

SUMMARY OF THE INVENTION

It is an object of the present invention to provide a printer for the printing of variable data on a pre-printed substrate web in which these disadvantages can be overcome. More particularly, it is an object of the present invention to provide such a printer in which any correction in the timing of the printing sequence is made between images, and in response to the detection of a single mark carried on the substrate web, the mark being associated in terms of position reference with the image to be printed.

We have discovered that these objects, and other useful advantages, may be obtained where the printer includes a digital printing station and a printing sequence is initiated at the printing station in response to the sensing of each of a plurality of synchronisation marks.

According to a first aspect of the invention there is provided a printer for printing a plurality of images on a substrate web carrying a plurality of synchronisation marks, the printer comprising:

- a digital printing station;
- a support for a roll of the substrate web;
- means for continuously feeding the substrate web from the roll past the printing station;
- a sensing device positioned upstream of the printing station for sensing the synchronisation marks on the web; and
- control means for initiating a printing sequence at the printing station in response to the sensing of each of the synchronisation marks, whereby a plurality of images are printed on the web, each at a predetermined location in the transport direction relative to an associated one of the synchronisation marks.

According to a second aspect of the invention, there is provided a method for printing a plurality of images on a substrate web carrying a plurality of synchronisation marks, the method comprising:

- continuously feeding the substrate web from a roll past a printing station;
- sensing the synchronisation marks on the web device at a position upstream of the printing station; and
- initiating a printing sequence at the printing station in response to the sensing of each of the synchronisation marks, whereby a plurality of images are printed on the web, each at a predetermined location in the transport direction relative to an associated one of the synchronisation marks.

The printer will usually further comprise means such as an encoder for generating signals indicative of web displacement, the control means being adapted to act in response to such web displacement signals. In this manner, the control device operates independently of the web speed, and is in particular insensitive to variations in the web speed.

The printer may further comprise a cutting device positioned downstream of the printing station, for cutting the web into sheets, each cut sheet carrying an image and its associated synchronisation mark. The cutting device is controlled by the control device to cut the web at a predetermined location in the transport direction relative to an associated one of the synchronisation marks.

The sensing device is preferably sensitive to pre-printed synchronisation marks on the substrate web, watermarks in the substrate web, and/or disconformities in the substrate web. For example, the sensing device is sensitive to pre-printed synchronisation marks distinguishable in the visible spectrum. The preferred longitudinal dimension (direction of web movement) of each synchronisation mark depends upon the expected web speed, and is, for example, at least 0.6 mm, typically from 1.00 mm to 4.00 mm, at a web speed of about 120 mm/sec. A lateral dimension of at least 10 mm should be sufficient to allow for variations in cross-web alignment. At a web speed of about 120 mm/sec, the spacing between consecutive marks should be at least 0.6 mm. When a visible pre-printed mark is used, this may be of any color, but a yellow mark on a white substrate is best avoided since it is more difficult to detect with conventional sensors, than other colors. The synchronisation mark may be located in a margin, i.e. to one side of the image to be printed, between adjacent pages, within the area to be occupied by the image, or even as part of the image. The latter will more usually be the case when the synchronisation mark is a watermark or a disconformity in the substrate web. A reflective optical sensor is suitable for detecting synchronisation marks in the form of printed marks or punched holes, whereas a transmissive optical sensor is suitable for detecting watermarks, security items within the substrate web or die-cuts. A non-optical sensor can be used to detect non-conformities in the substrate web.

The sensor may be adapted to distinguish the synchronisation marks from other marks on the substrate web. Thus the sensor may be an intelligent sensor capable of recognising synchronisation marks of a predetermined shape and distinguishing these from other marks which may occur on the web. This is important where the substrate web is pre-printed, for example with a form layout, and the synchronisation mark is to be located other than in a otherwise empty margin. The intelligence may be incorporated in the sensor itself, or in the control device. The images may be variable images to be printed in a predetermined sequence, the printing of each image at the printing station being initiated by the sensing of an associated synchronisation mark on the substrate web. Ideally, the printing of each image at the printing station is initiated only by the sensing of an associated synchronisation mark on the substrate web, whereby failure to sense an expected synchronisation mark on the substrate web results in failure to initiate the printing of an image at the printing station. Alternatively, failure to sense an expected synchronisation mark on the substrate web may result in the initiation of the printing of an image at said printing station, albeit based on an extrapolated position calculated from the position of earlier sensed synchronisation marks and their running average inter-distance.

The sensor will usually be located in a fixed position. By this arrangement it is possible to sense synchronisation marks associated with the start of a second page, while a first page is still printing. This is in contrast to arrangements such as described in EP 624477 (Canon K K) where a mark detector moves laterally into a parking position as printing continues.

One or more further printing stations may be provided, the feed means feeding the substrate web past each printing station in turn, enabling multi-color images to printed on the web substrate. In this embodiment, register control means may be provided for initiating a printing sequence at each printing station other than the first, in response to the start of printing at the first printing station, making use of web-displacement measurement, thereby enabling multicolor images to be printed in register with each other.

The method according to the invention may be used for the printing of identity documents, wherein the web substrate carries watermarks or security marks such as finely detailed images in at least one color, and the printed images comprise variable data such as alpha-numeric data and multi-color pictorial images. Other product examples include form printing, the printing of pre-die cut labels, flyers and direct mail documents carrying glued areas or perfume strips.

BRIEF DESCRIPTION OF THE DRAWING

The invention will now be described in further detail, purely by way of example, with reference to the accompanying drawings, in which.

DETAILED DESCRIPTION

Figure 1:
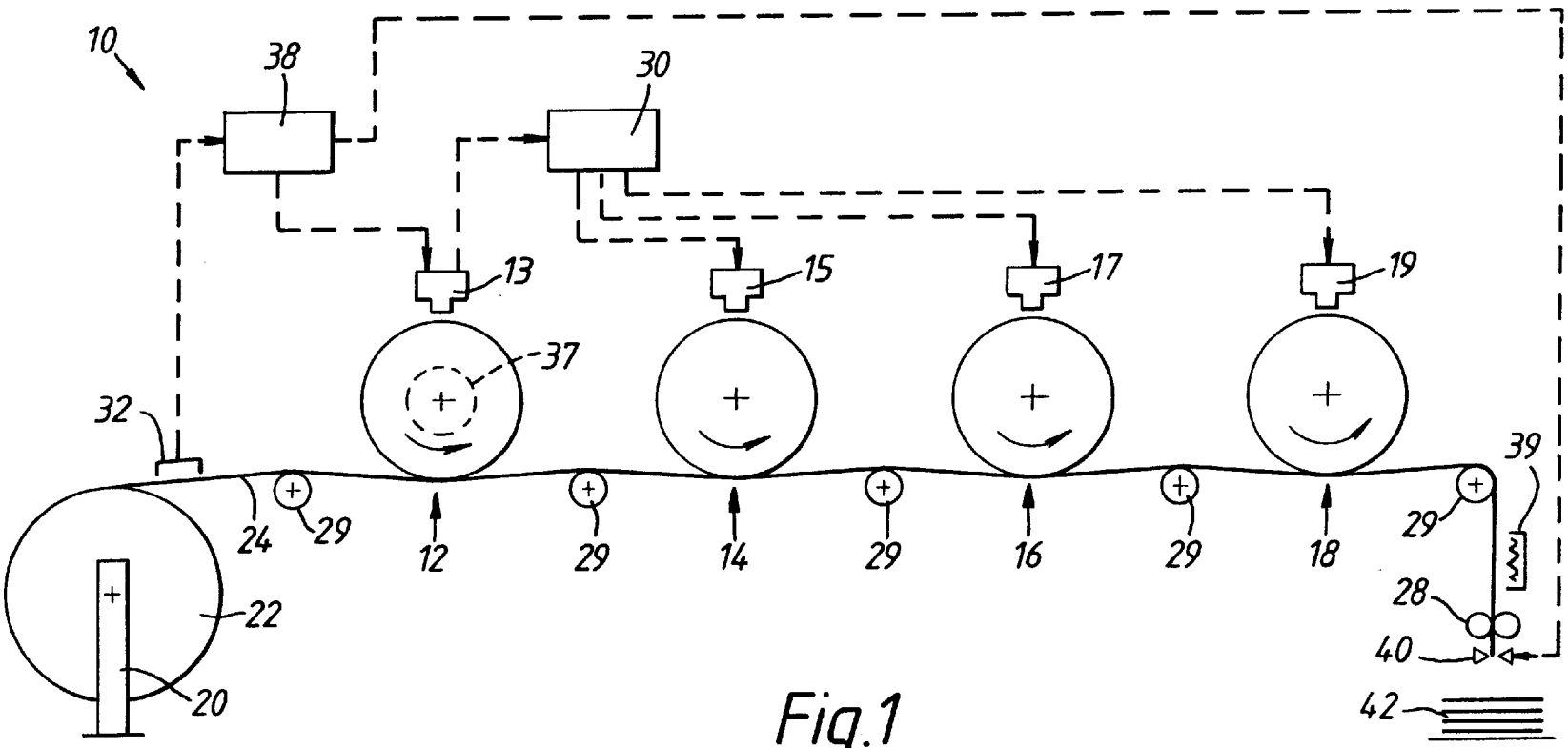
FIG. 1 is a schematic illustration of a printer according to the invention.

As shown in FIG. 1, the printer 10 comprises a plurality of digital printing stations 12, 14, 16, 18. Each printing station comprises a rotatable drum having photosensitive surface, an exposure device for image-wise exposing the photosensitive surface, a development unit to form a toner image, a transfer device for transferring the toner image to the substrate web, a cleaning device for removing excess toner form the photosensitive surface and a charging device for preparing the photosensitive surface for further exposure. Such a construction of the printing stations is conventional and is, for example, as described in U.S. Pat. No. 5,499,093 (Aerens et al. assigned to Xeikon NV), and is not therefore shown in detail. The exposure devices are however indicated at 13, 15, 17, 19. It will be appreciated that the timing of the operation of an exposure device determines the timing of image printing at that printing station, as described in U.S. Pat. No. 5,499,093.

A support 20 for a roll 22 of a substrate web 24. The web 24 carries a plurality of synchronisation marks (see FIG. 2). A pair of co-operating drive rollers 28 continuously feed the substrate web 24 past each printing station in turn, enabling multi-color images to printed on the substrate web 24. A brake (not shown) acting on the roll 22, ensures that the web is under tension as it passes the printing stations. The substrate path through the printer is defined by a number of guide rollers 29.

A sensing device 32 is positioned in a stationary position upstream in the transport direction of the first printing station 12 for sensing the synchronisation marks 26 on the web 24. The nature of the sensing device 32 is determined according to the nature of the synchronisation marks on the substrate web. A suitable sensing device is a reflective optical sensing device such as the KEYENCE FU-35FA sensor, with an F-2HA lens and an FS2-65 amplifier.

A control device 38, for example in the form of a microprocessor, is provided for initiating a printing sequence at the first printing station 12 in response to the sensing of each of the synchronisation marks. The images are, for example, variable images to be printed in a predetermined sequence, the printing of each image at the first printing station 12 being initiated by the sensing of an associated synchronisation mark 26 on the substrate web 24. Except in the case where the distance between the sensor and the point of printing on the web is the same as the distance between the exposure device and the point of printing on the web, it is necessary to provide means for generating signals indicative of web displacement. In the illustrated embodiment, an encoder device 37, associated for example with the first printing station 12, is provided to provide output signals to the control device 38 indicative of web displacement.

Since the printing of each image at the first printing station 12 is initiated only by the sensing of an associated synchronisation mark on the substrate web 24, failure to sense an expected synchronisation mark on the substrate web 24 results in failure to initiate the printing of an image at the printing station. The control device 38 also includes means to determine that a synchronisation mark is missing from within a pre-selectable range wherein normally a mark is to be expected. Where such a mark is missing, a printing sequence is optionally initiated, albeit based on an extrapolated position calculated from the position of earlier marks and their running average inter-distance. Thus any irregularity in the pre-printing of the substrate web 24 is overcome.

The printer shown in FIG. 1 operates as follows. As the substrate web 24 is drawn off the roll 22, a synchronisation mark thereon eventually passes the sensor 32 and is detected thereby. The control device 38 receives a signal from the sensor 32 that a synchronisation mark has been detected. After a given distance of web travel, the control device sends a signal to the exposure device 13 of the first printing station 12, to initiate a printing sequence. The given distance of web travel between receiving the signal from the sensor 32 and initiating the printing sequence at printing station 12 is pre-calibrated to take account of:

- the web path distance from the sensor 32 to the first printing station 12;
- the distance travelled by the web after the initiation of the printing sequence before the first printing station 12 causes an image to be formed on the web 24; and the desired longitudinal displacement between the position of the synchronisation mark and the start of the image.

When a second synchronisation mark is detected by the sensor 32, the control device 38 initiates a second printing sequence, and so on. The spacing of the synchronisation marks on the web 24 and the lengths of the images to be printed at the printing station 12, need not be regular, since each image is associated with a specific synchronisation mark. In this manner a plurality of images are printed on the web 24, each at a predetermined location in the transport direction relative to an associated one of the synchronisation marks 26.

The further printing stations 14, 16 and 18 enable multi-color images to be printed. Register control means 30 are provided for initiating a printing sequence at each of these further printing stations, in response to the start of printing at the first printing station 12, making use of web displacement measurements thereby enabling multi-color images to be printed in register with each other. If no printing sequence is initiated at the first printing station 12, no images are printed by the further printing stations 14, 16, 18.

After passing the last printing station 18, the web passes a toner image fixing station 39 where the images are rendered permanent on the substrate web 24. The web then passes to a cutting device 40 for cutting the web 24 into sheets 42, each cut sheet carrying an image and its associated synchronisation mark. The cutting device is controlled by the control device 38 to cut the web at a predetermined location in the transport direction relative to an associated one of the synchronisation marks 26.

The printer 10 may be used for the printing of identity documents, wherein the substrate web 24 carries security data for example in monochrome, and the printed images comprise variable multi-color pictorial images.

Figure 2:
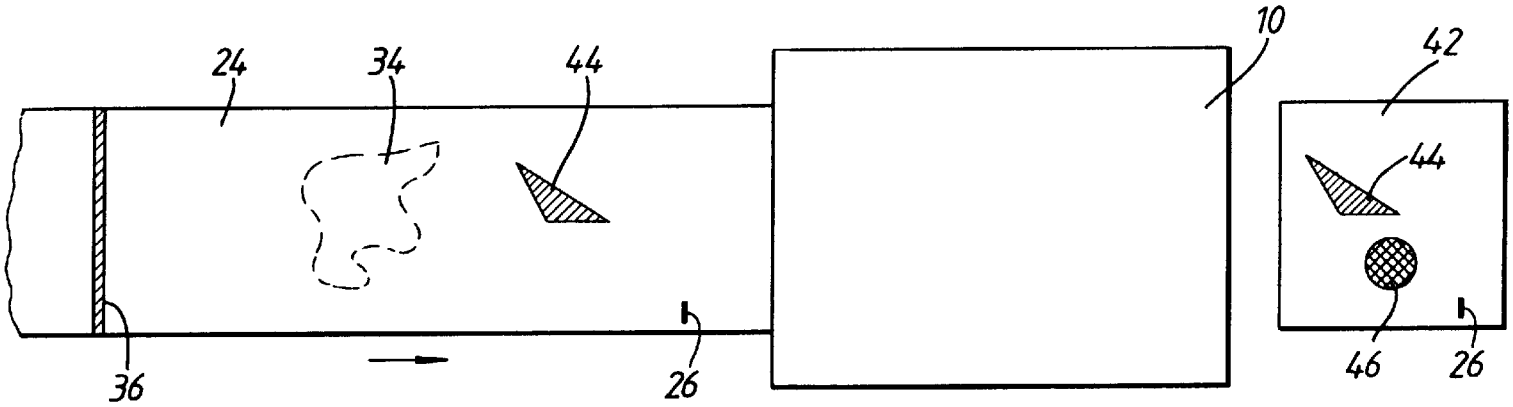
FIG. 2 shows part of a substrate web carrying synchronisation marks of various forms.

As shown in FIG. 2, the synchronisation marks on the substrate web 24 may take the form of pre-printed synchronisation marks 26 distinguishable in the visible spectrum, watermarks 34 formed in the substrate web, or disconformities such as metal strips 36 incorporated in the substrate web 24. FIG. 2 shows, as an example, a portion of substrate web 24 approaching the printer 10. The substrate web is pre-printed with an image shown diagrammatically at 44. In the case of printing identity cards for example, this may be made up of finely detailed images or alpha-numeric data. The substrate passes through the printer 10, where a multi-color further image shown diagrammatically at 46 is printed, and the web is cut into a sheet 42 of desired length. The newly printed image 46 may be for example a pictorial image of the person to whom the identity card is to apply. The image 46 has been printed at a predetermined location in the transport direction relative to the pre-printed image 44. The printed sheet 42 thus carries both images 44, 46 and the synchronisation mark 26. In the illustrated example, the synchronisation mark 26 lies in a margin to the image area. This has the advantage that, if desired, such synchronisation marks may be removed by subsequently trimming the sheet. Printed sheets carrying watermarks 34 or metal strips 36, will usually retain these features within the image area. This can be desirable for security reasons.

The printer according to the invention may be adapted for duplex printing (i.e. printing on both faces of the substrate web), for example by the provision of further printing stations located on the opposite side of the web, such as in replacement for the guide rollers 29.

Figure 3:
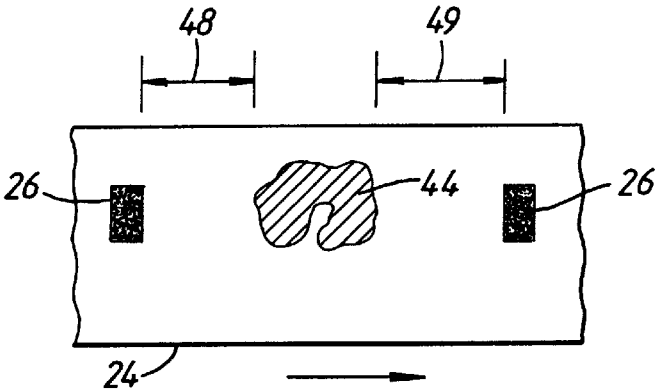
FIG. 3 illustrates the principle of distinguishing between synchronisation marks on the web and image data.

Referring to FIG. 3, the sensor may be an intelligent sensor capable of recognising synchronisation marks of a predetermined shape and distinguishing these from other marks which may occur on the web. In this case the web 24 carries synchronisation marks 26 which lie within the image area, which area also includes a pre-printed image 44, or may be part of the image. The sensor is able to distinguish the synchronisation marks from the image 44, by being programmed to apply the following criteria. Firstly, the synchronisation marks 26 must have a length in the web travelling direction falling within a configurable range. Secondly, the optical density of the synchronisation marks 26 must fall within a predetermined range relative to the un-printed substrate. The synchronisation marks 26 must be preceded and followed by blank areas 48, 49 of a configurable length. Furthermore, the sensor may be programmed to ignore any marks occurring on the web within a predetermined length range following a detected synchronisation mark. By application of these criteria, the synchronisation marks 26 may be distinguished from pre-printed images 44.

A number of synchronisation marks of different configurations may be used in combination, the sensor intelligence being adapted to detect the sequence of such marks.

We claim:

1. A printer for printing a plurality of images on a substrate web carrying a plurality of synchronisation marks, said printer comprising:

- a digital printing station comprising a rotatable drum having a photosensitive surface and an exposure device for image-wise exposing said photosensitive surface;
- a support for a roll of said substrate web;
- feeding means for continuously feeding said substrate web from said roll past said printing station in a transport direction;
- a sensing device positioned in a stationary position upstream of said printing station for sensing said synchronisation marks on said web;
- signal generating means associated with said printing station for generating signals indicative of web displacement; and
- control means for initiating a printing sequence at said printing station by causing said exposure device to expose said photosensitive surface after a given distance of web displacement in response to each of said synchronisation marks being sensed and in response to said signals indicative of web displacement, said given distance of web displacement being pre-calibrated by said control means to take into account (i) the distance between said sensing device and said printing station, (ii) the distance traveled by said web after initiation of said printing sequence before said printing station causes an associated image to be formed on said web, and (iii) the longitudinal displacement between the position of said synchronisation mark and the desired start of said associated image, whereby a plurality of images are printed on said web, each at a predetermined location in said transport direction relative to an associated one of said synchronisation marks.

2. The printer of claim 1, wherein said synchronisation marks on said web are selected from pre-printed synchronisation marks on said substrate web, watermarks in said substrate web, disconformities in said substrate web, and combinations thereof.

3. The printer of claim 3, wherein said synchronisation marks are visibly distinguishable synchronisation marks and said sensing device is capable of distinguishing said visibly distinguishable synchronisation marks.

4. The printer of claim 1, wherein said sensing device is adapted to distinguish said synchronisation marks from other marks on said substrate web.

5. The printer of claim 1, further comprising a cutting device positioned downstream of said printing station, for cutting said web into cut sheets, each said cut sheet carrying an image and its associated synchronisation mark, said cutting device being controlled by said control device to cut said web at a predetermined location in said transport direction relative to an associated one of said synchronisation marks.

6. The printer of claim 1, wherein one or more further printing stations are provided and said feed means feeds said substrate web past each said further printing station in turn, enabling multi-color images to printed on said substrate web.

7. The printer of claim 6, further comprising register control means for initiating a printing sequence at each said further printing station, said register control means being responsive to a start of printing at a first printing station, thereby enabling multi-color images to be printed in register with each other.

8. A method for printing a plurality of images on a substrate web carrying a plurality of synchronisation marks, said method comprising:

continuously feeding said substrate web from a roll past a digital printing station in a transport direction, said digital printing station including a rotatable drum having a photosensitive surface and an exposure device for image-wise exposing said photosensitive surface;

sensing said synchronisation marks on said web at a fixed position upstream of said printing station;

generating signals indicative of web displacement at said printing station; and initiating a printing sequence at said printing station by causing said exposure device to expose said photosensitive surface after a given distance of web displacement in response to each of said synchronisation marks being sensed and in response to said signals indicative of web displacement, said given distance of web displacement being pre-calibrated to take into account (i) the distance between said sensing device and said printing station, (ii) the distance traveled by said web after initiation of said printing sequence before said printing station causes an associated image to be formed on said web, and (iii) the desired longitudinal displacement between the position of said synchronisation mark and the start of said associated image, whereby a plurality of images are printed on said web, each at a predetermined location in said transport direction relative to an associated one of said synchronisation marks.

9. The method of claim 8, wherein said synchronisation marks on said substrate web are selected from pre-printed synchronisation marks, watermarks, disconformities in said substrate web, and combinations thereof.

10. The method of claim 9, wherein said synchronisation marks are visibly distinguishable synchronisation marks.

11. The method of claim 8, further comprising distinguishing said synchronisation marks from other marks on said substrate web.

12. The method of claim 8, wherein said images are variable images to be printed in a predetermined sequence, printing of each said variable image at said printing station being initiated by sensing an associated said synchronisation mark on said substrate web.

13. The method of claim 12, wherein printing of each image at said printing station is initiated only by sensing of an associated said synchronisation mark on said substrate web, whereby failure to sense an expected synchronisation mark on said substrate web results in failure to initiate image printing at said printing station.

14. The method of claim 12, whereby failure to sense an expected synchronisation mark on said substrate web results image printing being initiated at said printing station at an extrapolated position on said substrate web.

15. The method of claim 8, further comprising cutting said web into cut sheets at a position downstream of said printing station, each said cut sheet carrying an image and its associated said synchronisation mark, said cutting device being controlled by said control device to cut said web at a predetermined location in said transport direction relative to said associated synchronisation mark.

16. The method of claim 8, wherein at least one further printing station is provided and said substrate web is fed past each printing station in turn, enabling multi-color images to printed on said substrate web.

17. The method of claim 16, wherein printing at said at least one further printing station is started in response to a start of printing at a first printing station, thereby enabling multi-color images to be printed in register with each other.

18. The method of claim 16, for printing identity documents, wherein said substrate web carries security images in at least one color, and said printed images comprise variable alpha-numeric and/or multi-color pictorial images.

* * * * *

UNITED STATES PATENT AND TRADEMARK OFFICE

CERTIFICATE OF CORRECTION

PATENT NO. : 5,951,182
DATED : September 14, 1999
INVENTOR(S) : Van Weverberg et al.

It is certified that error appears in the above-identified patent and that said Letters Patent is hereby corrected as shown below:

Column 7,
Line 22: "claim 3," should read -- claim 2, --.

Signed and Sealed this

Twenty-fourth Day of July, 2001

*Attest:*

Nicholas P. Godici

*Attesting Officer*

NICHOLAS P. GODICI
*Acting Director of the United States Patent and Trademark Office*